US008919841B2

(12) United States Patent
Havens et al.

(10) Patent No.: US 8,919,841 B2
(45) Date of Patent: Dec. 30, 2014

(54) METHOD AND APPARATUS FOR ATTACHMENT OF A SECONDARY TOOL HANDLING DEVICE TO A PRIMARY TOOL HANDLING DEVICE

(71) Applicant: Forum Energy Technologies, Inc., Houston, TX (US)

(72) Inventors: David J. Havens, Houston, TX (US); Lawrence E. Childress, II, Lafayette, LA (US); Robert Dugal, Spring, TX (US)

(73) Assignee: Forum Energy Technologies, Inc., Houston, TX (US)

( * ) Notice: Subject to any disclaimer, the term of this patent is extended or adjusted under 35 U.S.C. 154(b) by 0 days.

(21) Appl. No.: 13/857,201

(22) Filed: Apr. 5, 2013

(65) Prior Publication Data

US 2013/0264838 A1 Oct. 10, 2013

Related U.S. Application Data

(60) Provisional application No. 61/620,890, filed on Apr. 5, 2012, provisional application No. 61/787,526, filed on Mar. 15, 2013.

(51) Int. Cl.
*E21B 19/06* (2006.01)

(52) U.S. Cl.
CPC ..... *E21B 19/06* (2013.01)
USPC ..... 294/102.2; 294/215; 166/77.52

(58) Field of Classification Search
CPC ..... B66C 1/48; E21B 19/06; E21B 19/07; E21B 19/16
USPC ..... 294/90, 91, 102.1, 102.2, 215; 166/379, 166/380, 382, 77.52
See application file for complete search history.

(56) References Cited

U.S. PATENT DOCUMENTS

| | | | | |
|---|---|---|---|---|
| 2,030,087 | A * | 2/1936 | Young et al. | 294/90 |
| 6,378,614 | B1 * | 4/2002 | Adams et al. | 166/382 |
| 6,679,333 | B2 | 1/2004 | York et al. | |
| 6,832,658 | B2 * | 12/2004 | Keast | 175/170 |
| 7,303,021 | B2 * | 12/2007 | Schats et al. | 166/379 |
| 7,370,707 | B2 | 5/2008 | McDaniel et al. | |
| 7,997,333 | B2 * | 8/2011 | Angelle et al. | 166/77.52 |

* cited by examiner

*Primary Examiner* — Dean Kramer
(74) *Attorney, Agent, or Firm* — Patterson & Sheridan, L.L.P.

(57) ABSTRACT

Embodiments of the invention provide methods and apparatus for a handling system and attachment of a secondary elevator, and/or other complementary equipment, to a primary elevator. In one embodiment, a casing elevator is provided. The casing elevator includes a body, two first load-rated lift members coupled to a perimeter of the body at a first location on the body, and two second load-rated lift members coupled to the perimeter of the body at a second location on the body, the second location being different than the first location.

3 Claims, 6 Drawing Sheets

METHOD AND APPARATUS FOR ATTACHMENT OF A SECONDARY TOOL HANDLING DEVICE TO A PRIMARY TOOL HANDLING DEVICE

CROSS-REFERENCE TO RELATED APPLICATION

This application claims benefit of U.S. Provisional Patent Application Ser. No. 61/620,890, filed Apr. 5, 2012, and U.S. Provisional Patent Application Ser. No. 61/787,526, filed Mar. 15, 2013, both of which are hereby incorporated by reference herein.

BACKGROUND OF THE INVENTION

1. Field of the Invention

Embodiments of the invention generally relate to methods and apparatus for attachment of a secondary tool handling device to a primary tool handling device. More specifically, the embodiments relate to methods and apparatus for attachment of a secondary elevator to a primary elevator on a drilling rig used in the oil and gas industry.

2. Description of the Related Art

In a drilling operation or rig work-over operation, a tubular handling system is utilized to support tubular members or circular tools, such as casing, tubing, drill pipe, or sucker rods, and position and/or lift or lower the tubular members relative to a wellbore or platform. A conventional drilling or work-over rig typically includes a primary elevator that supports the tubular members for the positioning and/or lifting and lowering. The elevator is typically coupled to a travelling block (i.e., a support structure) by links above the wellbore, which allows the elevator to move up and down when handling the tubular members. The elevator most commonly used in the operations described above may be an elevator suitable for safely handling multiple joints of tubular members, such as a casing elevator, although other elevators may be utilized as the primary elevator.

During these operations it is sometimes necessary or practical to use a secondary elevator that is different than the primary elevator. For example, the secondary elevator may be suitable for safely handling a single joint of a tubular member, such as a single joint elevator. Traditionally, the secondary elevator is either attached directly to the lower link ears of a standard elevator. However, the lower link ears are not load-rated, which creates safety risks. Alternatively, the secondary elevator is attached to the travelling block providing support to the primary elevator. However, this attachment method requires an independent, extended support sling that is routed from the travelling block, down the elevator links and past the primary elevator. This method requires the use of various attachment mechanisms to secure the sling to the primary elevator and links. The use of a sling and other attachment mechanisms in this manner causes instability of the secondary elevator, and creates a potential safety risk as the sling and other attachment mechanisms can get caught in other rigging gear. In addition, these attachment mechanisms represent additional potential for dropped objects.

What is needed is a method and apparatus for safely attaching a secondary elevator to a primary elevator that does not require the use of extended slings and includes a load-rated attachment point and mechanism for attachment of the secondary elevator.

SUMMARY OF THE INVENTION

Embodiments of the invention provide methods and apparatus for a handling system and attachment of a secondary elevator, and/or other complementary equipment, to a primary elevator as provided in the claims and described herein.

In one embodiment, a casing elevator is provided. The casing elevator includes a body, two first load-rated lift members coupled to a perimeter of the body at a first location on the body, and two second load-rated lift members coupled to the perimeter of the body at a second location on the body, the second location being different than the first location.

In another embodiment, a handling system for gripping circular tools is provided. The system comprises a first elevator having a body, a pair of lift hooks coupled to the body, a first support plate coupled to a first side of the body, and a second support plate coupled to a second side of the body, the first side being opposite of the first side, and a second elevator coupled to the first elevator by a plurality of support members attached to the first support plate and the second support plate, at least one of the support members preventing rotational movement of the second elevator about a longitudinal axis of the first elevator.

In another embodiment, a handling system for gripping circular tools is provided. The system comprises a first elevator. The first elevator comprises a body, two first load-rated lift members coupled to a perimeter of the body at a first location on the body, and two second load-rated lift members coupled to the perimeter of the body at a second location on the body, the second location being different than the first location. The system also comprises a second elevator coupled to the first elevator by a plurality of support members attached to the second load-rated lift members, wherein a swivel device coupled to at least one of the plurality of support members at a position the first elevator and the second elevator.

BRIEF DESCRIPTION OF THE DRAWINGS

So that the manner in which the above recited aspects of the invention can be understood in detail, a more particular description of embodiments of the invention may be had by reference to the appended drawings. It is to be noted, however, that the appended drawings illustrate only typical embodiments of this invention and therefore are not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

According to the embodiments, provided are methods and apparatus for attachment of a secondary elevator or additional complementary equipment to a primary (first) elevator or additional complementary equipment for use on a drilling rig used in the oil and gas industry. The additional complementary equipment can include, but is not limited to, casing running tools, fill up equipment or subs. In addition, swivel systems and thread compensation systems are examples of devices that may be used as tertiary equipment in conjunction with the primary and secondary equipment.

Figure 1A:
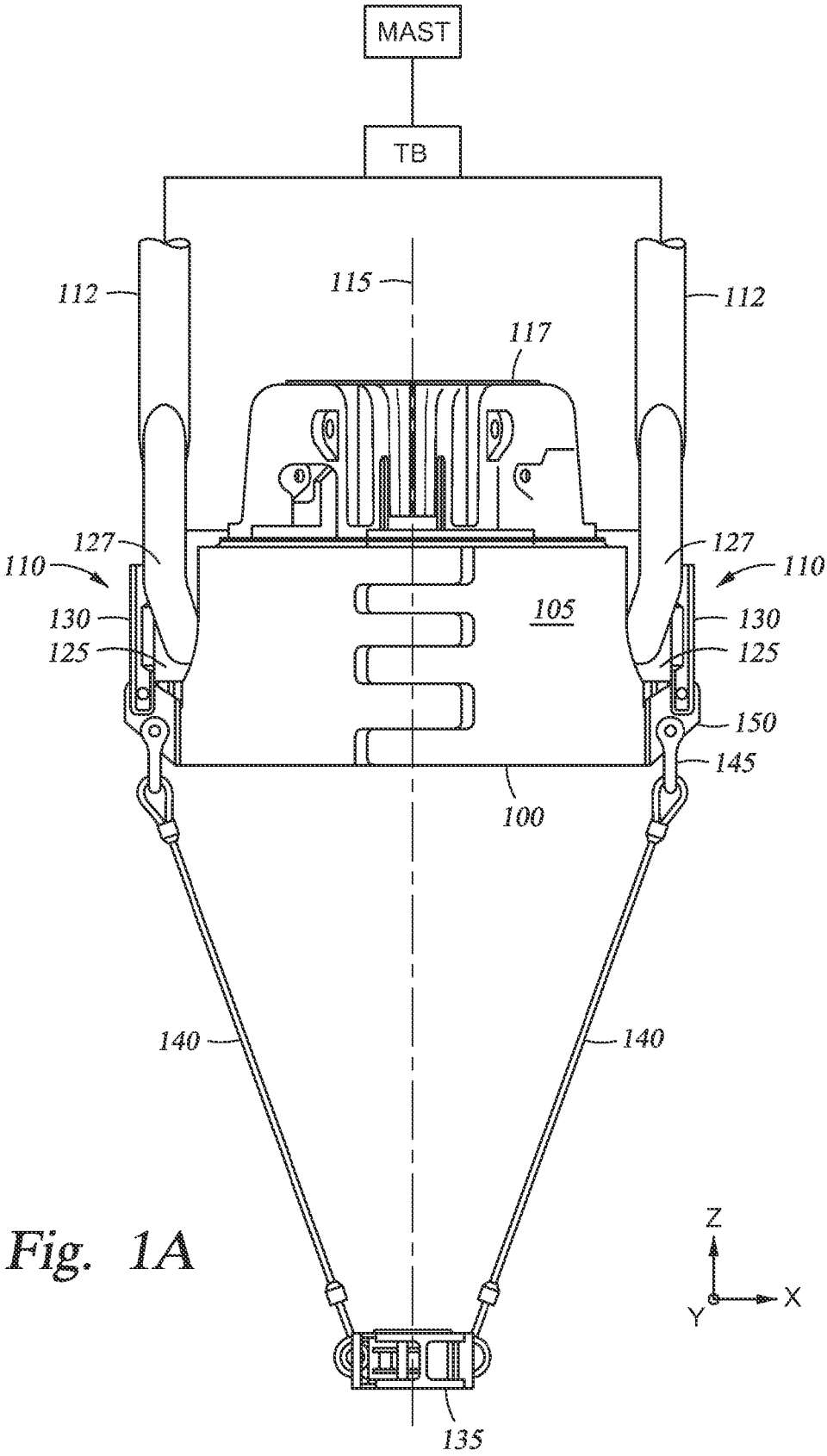
FIG. 1A is a side view of a first elevator coupled to a second elevator showing one embodiment of the invention.
Figure 1B:
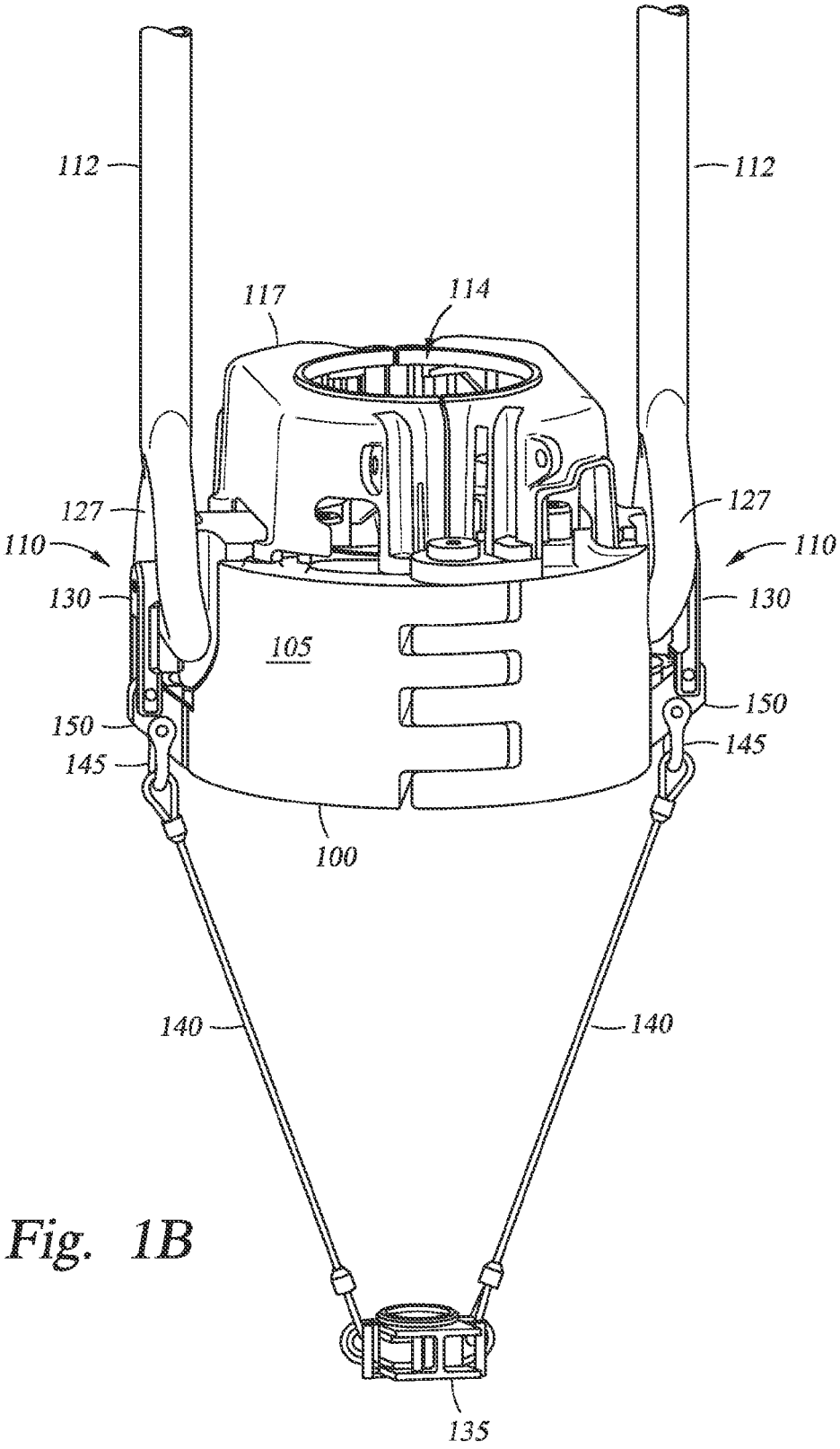
FIG. 1B is an isometric view of the first elevator and the second elevator shown in FIG. 1A.

FIG. 1A is a side view of a primary or first elevator 100, such as a casing elevator, having attached thereto a secondary or second elevator 135, such as a single joint elevator. FIG. 1B is an isometric view of the first elevator 100 and the second elevator 135 shown in FIG. 1A. The first elevator 100 includes a body 105 having two lift hooks 110 disposed on opposing sides of the body 105. Each of the lift hooks 110 provides a surface for attachment of a respective link 112. Each link 112 is coupled to a travelling block TB. The travelling block TB is suspended from a mast and is coupled to a winch or other device (not shown) that allows the travelling block TB to move at least vertically (Z direction). The links 112 support the first elevator 100 and allow the first elevator 100 to move with the travelling block TB. The body 105 also includes an opening 114 formed through the body 105 along a longitudinal axis 115. An upper portion 117 of the body 105 may include clamping devices (e.g., "slips") that grip a portion of a tubular member (not shown) in the opening 114 along the longitudinal axis 115 of the body 105.

Each of the lift hooks 110 includes an opening 125 that receives a portion of a looped portion 127 of the link 112 therein. The openings 125 may be selectively closed by a movable safety latch 130 designed to secure the looped portion 127 of each link 112 in the opening 125 when the first elevator 100 is in use.

The second elevator 135 is coupled to a lower portion of the body 105 of the first elevator 100 by support members 140. The support members 140 are coupled to a fastening device 145 that are coupled to a support plate 150 disposed on the body 105 below the lift hooks 110. The support plate 150 may be a gusset having three or four sides, an ear, a lug, or other structural shape, having at least one side that is fastened to the body 105. The support plate 150 may include a hole formed therethrough to receive a pin of the fastening device 145. The support members 140 may be high strength lifting cables, chains, links, or other suitable strength member. One or more of the support members 140 may be rigid or semi-rigid in order to prevent rotational movement of the single joint elevator 135 about the longitudinal axis 115. Each of the fastening devices 145 may be a detachable link member or device, for example, a clevis fastener.

Figure 2A:
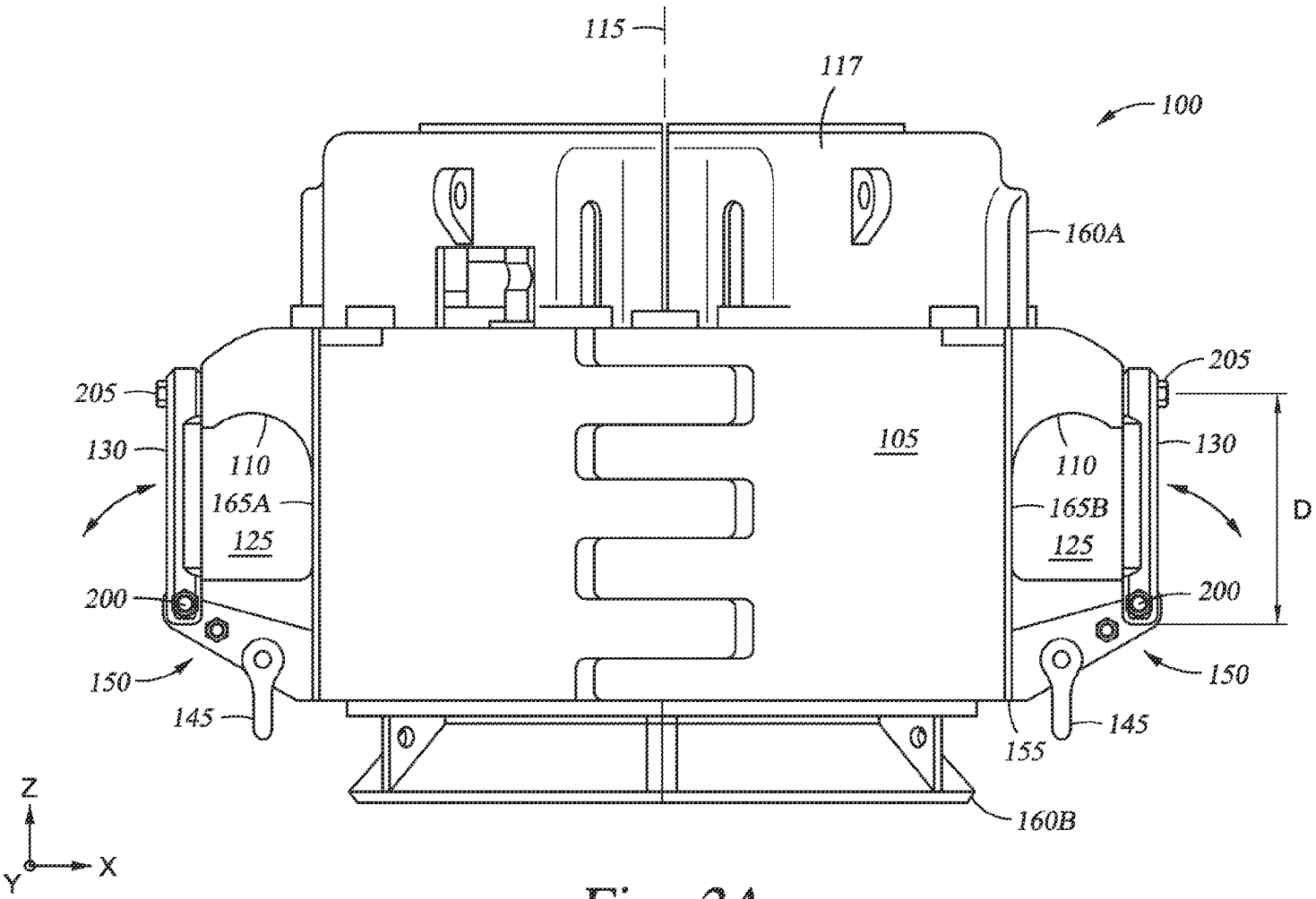
FIG. 2A shows a side view of the first elevator of FIGS. 1A and 1B.
Figure 2B:
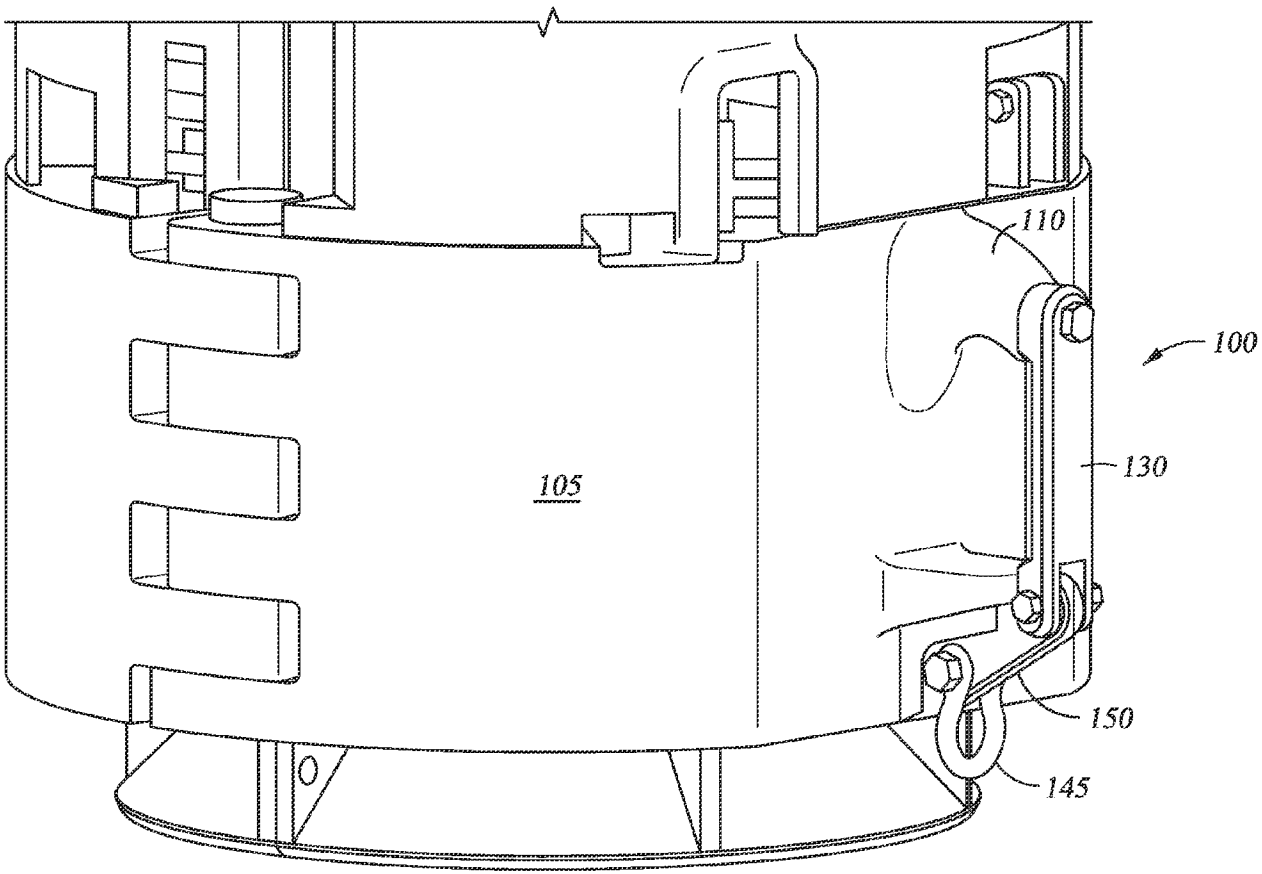
FIG. 2B is an isometric view of a portion of the first elevator of FIGS. 1A and 1B.

FIG. 2A shows a side view of the first elevator 100 of FIGS. 1A and 1B. FIG. 2B is an isometric view of a portion of the first elevator 100 of FIGS. 1A and 1B. In one example, as shown in FIGS. 2A and 2B, the support plate 150 has a dual function. A first function of the support plate 150 is providing a pivot point 200 for the movable safety latch 130. The pivot point 200 allows an upper portion of the movable safety latch 130 to pivot to and away from a respective lift hook 110 when a fastener 205 is removed. A second function of the support plate 150 is providing a support interface for attachment of the single joint elevator 135 (or other equipment) to the body 105 of the first elevator 100. However, in other embodiments that are not shown, the movable safety latch 130 may be coupled to other portions of the body 105 while allowing opening and closing of the movable safety latch 130, such that the support plate 150 may be a separate component that is solely used for the support interface when coupling with the second elevator 135 (shown in FIGS. 1A and 1B).

The first elevator 100 is designed and tested to safely support tubular members at a safe working capacity, which may be 500 tons in one example. The bulk of the working capacity is provided by, and the bulk of any working weight is supported by, the load-rated lift hooks 110, which are attached to the travelling block TB by the links 112 (both shown in FIGS. 1A and 1B). Likewise, the second elevator 135 is weight rated as well and may include a safe working capacity that may be 5 tons, in one example.

In conventional casing elevators, each movable safety latch 130 is coupled to the body 105 by a structure that secures the movable safety latch 130 and allows pivoting movement of the movable safety latch 130. However, the movable safety latch 130 and the structure coupled to the body 105 is merely a safety device that functions solely to secure the links 112 within the opening 125. The movable safety latches 130 and pivoting structure are typically a casting or forging of a material that is not strength tested. Thus, any structure suitable to provide a pivot point for the movable safety latch 130 may be used in the conventional casing elevator. However, the movable safety latch 130 and/or the pivoting structure utilized in conventional casing elevators is not suitable for weight-rated loads.

In the embodiments described herein, the support plate 150 is utilized as a load-rated strength member. In one aspect, the lift hooks 110 may be first lift members and the support plates 150 may be second lift members. In one embodiment, the support plate 150 is provided as an integral part of the body 105 of the first elevator 100. The support plate 150 may be formed of a material having high shear and tensile strength, and may comprise the same or different material than the body 105 is fabricated from. The support plate 150 may be load-rated to a safe working capacity of about 8 tons to about 10 tons in one example. In another embodiment, the support plate 150 may be formed as a separate element and made of a material having high shear and tensile strength. The support plate 150 may be load-rated to a safe working capacity of about 8 tons in one example. The support plate 150 may be coupled to the body 105 of the first elevator 100 by a suitable fastening method that assures the load rating is maintained. Examples of fastening methods include welding, high strength bolts, high strength rivets, or combinations thereof. Any welding process performed may be tested by known non-destructive testing methods to assure the load rating is maintained. While the support plate 150 is shown as providing the pivot point 200 for the movable safety latch 130, it is contemplated that another structure could provide the pivot point for the movable safety latch 130, in which the location of the support plate 150 may be different than what is shown in FIGS. 1A-2B.

In one embodiment, as shown in FIG. 2A, the lift hooks 110 are located at a first longitudinal or axial position on a perimeter 155 of the body 105 and the support plates 150 are located at a second longitudinal or axial position on the perimeter 155 of the body 105, and each of the first longitudinal position and the second longitudinal position is separated by an axial distance D. The first longitudinal position may be adjacent an upper end 160A of the body 105 and the second longitudinal position may be adjacent a lower end 160B of the body 105. Additionally, in this embodiment, the body 105 includes a first side 165A and a second side 165B that opposes the first side 165A (e.g., about 180 degrees apart). The first side 165A includes one lift hook 110 and one support plate 150 that share a common plane along the longitudinal axis (e.g., the Y-Z plane).

Figure 3A:
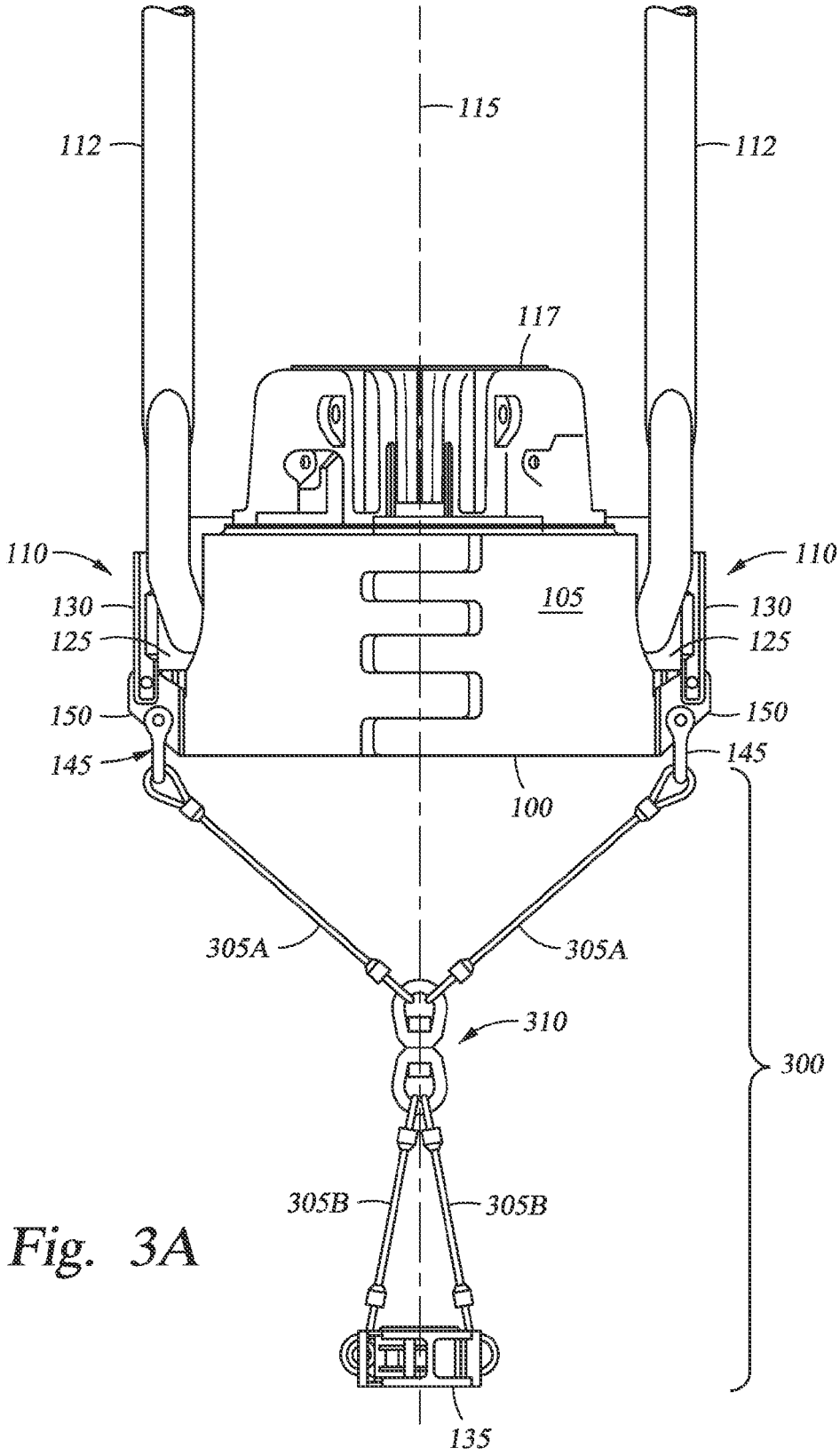
FIGS. 3A and 3B are side and isometric views, respectively, of the first elevator of FIGS. 2A and 2B, showing another embodiment of a secondary elevator coupling interface.
Figure 3B:
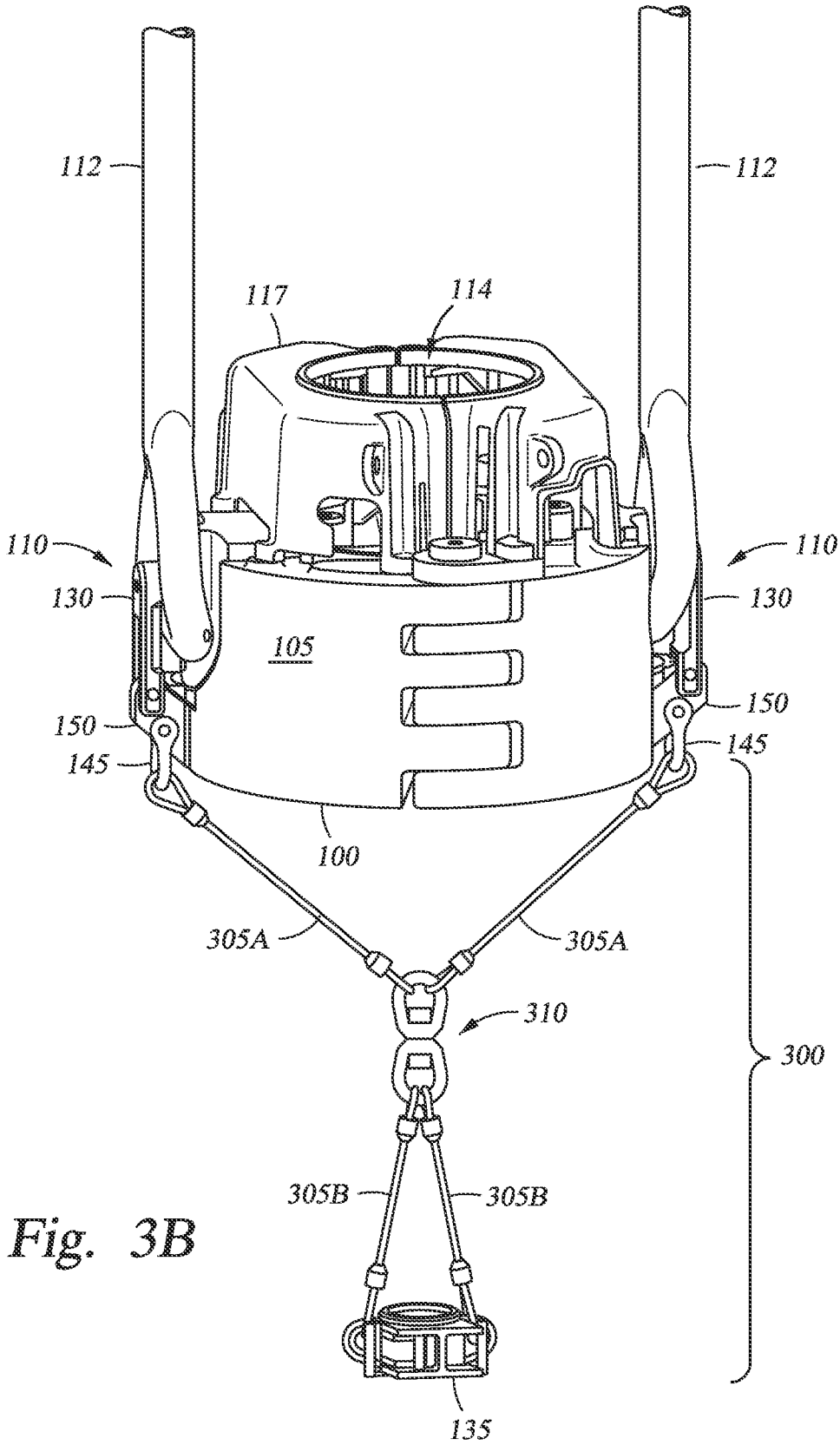

FIGS. 3A and 3B are side and isometric views, respectively, of the first elevator 100 of FIGS. 2A and 2B, showing another embodiment of a secondary elevator coupling interface. In this embodiment, the second elevator 135 is supported by the support plates 150 and a rotational support device 300. The rotational support device 300 comprises a first set of support members 305A that are coupled between each support plate 150 and a swivel device 310. The rotational support device 300 also includes a second set of support members 305B coupled between the swivel device 310 and the second elevator 135. The rotational support device 300 allows the second elevator 135 to rotate relative to the first elevator 100, which may be advantageous in handling of tubular members or circular tools.

Embodiments of the first elevator 100 having the support plates 150 as described herein provide a novel interface for safely and efficiently coupling of a secondary elevator 135 thereto. The benefits of the interface include minimizing downtime of a drilling or work-over operation by several hours, as well as providing a load tested support for handling the second elevator and any tubular members or tertiary equipment that may be coupled to one or both of the first elevator 100 and the second elevator 135.

While the foregoing is directed to embodiments of the invention, other and further embodiments of the invention may be devised without departing from the basic scope thereof, and the scope thereof is determined by the claims that follow.

The invention claimed is:

1. A handling system for gripping circular tools, the system comprising:

a first elevator, the first elevator comprising:

a body;

two first load-rated lift members coupled to a perimeter of the body at a first location on the body; and two second load-rated lift members coupled to the perimeter of the body at a second location on the body, the second location being different than the first location;

a second elevator coupled to the first elevator by a plurality of support members attached to the second load-rated lift members, wherein a swivel device is coupled to at least one of the plurality of support members at a position between the first elevator and the second elevator.

2. The system of claim 1, wherein the load-rating of the second load-rated lift members is about 8 tons.

3. The system of claim 1, wherein the load-rating of the second load-rated lift members is about 10 tons.

* * * * *